United States Patent [19]

Yamagishi et al.

[11] Patent Number: 5,033,750

[45] Date of Patent: Jul. 23, 1991

[54] GOLF BALL

[75] Inventors: Hisashi Yamagishi; Shinichi Kakiuchi, both of Yokohama; Seisuke Tomita, Tokorozawa, all of Japan

[73] Assignee: Bridgestone Corporation, Tokyo, Japan

[21] Appl. No.: 435,208

[22] Filed: Nov. 9, 1989

[30] Foreign Application Priority Data

Nov. 16, 1988 [JP] Japan ..... 63-289573

[51] Int. Cl.[5] ..... A73B 37/12

[52] U.S. Cl. ..... 273/232; 273/235 A

[58] Field of Search ..... 273/232, 213, 220; 40/327

[56] References Cited

U.S. PATENT DOCUMENTS

| | | | |
|---|---|---|---|
| 4,142,727 | 3/1979 | Shaw et al. | 273/232 |
| 4,772,026 | 9/1988 | Gobush | 273/232 |
| 4,804,189 | 2/1989 | Gobush | 273/232 |
| 4,813,677 | 3/1989 | Oka et al. | 273/232 |
| 4,858,923 | 8/1989 | Gobush et al. | 273/220 |
| 4,877,252 | 10/1989 | Shaw | 273/232 |
| 4,880,241 | 11/1989 | Melvin et al. | 273/232 |
| 4,915,390 | 4/1990 | Gobush et al. | 273/232 |
| 4,936,587 | 6/1990 | Lynch et al. | 273/232 |

OTHER PUBLICATIONS

European Search Report EP 0234081 A1 to Sumitomo Rubber Industries, date of filing 02-05-86, published 2-9-87.

*Primary Examiner*—George J. Marlo

[57] ABSTRACT

A golf ball with improved flight distance is disclosed. The golf ball has at least three pluralities of dimples in its spherical surface. The dimples of each plurality share the same diameter and depth characteristics, such characteristics varying from the corresponding diameter and depth characteristics of the dimples of the other pluralities of dimples. However, the ratio of the diameter to depth of the dimples of a particular plurality of dimples approximates the ratio of the dimples in every other plurality of dimples such that the difference between the ratio of the dimple of one plurality of dimples and any other plurality of dimples is less than 0.3.

5 Claims, 3 Drawing Sheets

①>②>③

$$\frac{D_1}{d_1} \simeq \frac{D_2}{d_2} \simeq \frac{D_n}{d_n}$$

$$\frac{D_1}{d_1} \cong \frac{D_2}{d_2} \cong \frac{D_n}{d_n}$$

GOLF BALL

This invention relates to golf balls having improved flying performance.

BACKGROUND OF THE INVENTION

For the purpose of improving the flying performance of golf balls, a variety of technical proposals were made from the past on the dimples of golf balls, particularly regarding the dimple distribution pattern and dimple configurations including dimensions such as diameter and depth. For example, U.S. Pat. No. 4,681,323 discloses the cross-sectional shape of dimples, U.S. Pat. No. 4,840,381 discloses the relationship between the cross-sectional shape and volume of dimples, and Japanese Patent Application Kokai No. 51871/1988 discloses the distribution of dimples. There are commercially available many golf balls to which these proposals are applied. However, there exists a demand for further improving the flying performance of golf balls.

The dimples on a golf ball play the role of assisting the transition of a boundary layer created in proximity to the ball surface due to motion and rotation of the ball from laminar flow to turbulent flow to move the point of separation rearward, thereby reducing pressure drag and creating a lifting force due to the difference of separation point between upper and lower positions of the ball. The separation point varies as various dimple parameters such as diameter and depth are changed. Thus the flying orbit of a golf ball is determined by a particular setting of dimple parameters.

Prior art efforts were concentrated on the diameter, depth, cross-sectional shape, and distribution of dimples as previously described. However, the situation is somewhat different with those golf balls having two or more different types of dimples though they have been marketed for some time. They are merely available as combinations of dimples having large and small diameters, but the same depth. No attention has been paid to the relationship between the diameter and the depth of different types of dimples. A mere combination of dimples having large and small diameters means that dimples having different aerodynamic properties are coexisting in a single ball, which deleteriously affects the flying performance of the ball.

SUMMARY OF THE INVENTION

Therefore, an object of the present invention is to provide a novel and improved golf ball having improved flying performance wherein the relationship between the diameter and depth of each dimple is optimized among two or more different types of dimples.

Regarding a golf ball having at least two different groups of dimples, we compared the ratio of diameter to depth of each dimple among the different groups of dimples. When the difference of said ratio between one group and another group of dimples is up to 0.3, the dimples of one group are in substantial or complete conformity to those of the other group. Then all the dimples show substantially identical aerodynamic properties so that the individual dimples may exert their own function in an effective and synergistic manner, leading to improved flying performance.

According to the present invention, there is provided a golf ball comprising at least two different types of dimples arranged on the spherical surface of the ball wherein the difference between the diameter divided by the depth of each dimple for one type of dimples and that for another type of dimples is up to 0.3.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
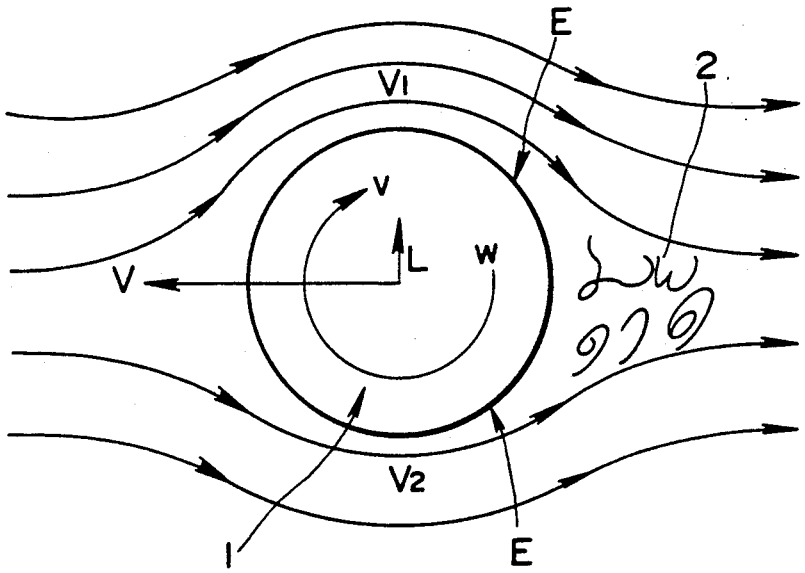
FIG. 1 illustrates what forces act on a ball being in relative motion with air while rotating.

The dimples on a golf ball play the roles of reducing pressure drag and creating a lifting force as previously described. This will be briefly described with reference to FIG. 1. Now, a ball or sphere 1 is in motion to the left in air at a velocity V while making a spin w about its axis at a tangential velocity v. The velocity V1 of air relative to the ball 1 is equal to (V+v) in proximity to a top surface of the ball 1 while the velocity V2 of air relative to the ball 1 is equal to (V−v) in proximity to a bottom surface of the ball 1. The difference between the velocity V1 of air passing in proximity to the ball top surface and the velocity V2 of air passing in proximity to the ball bottom surface creates a pressure difference between the top and the bottom of the ball 1, by virtue of which an upward lift L is developed. This phenomenon is known as Magnus effect. By forming dimples in the surface of the ball 1, it becomes possible to increase the differential velocity of air between the top and the bottom of the ball to thereby increase the lift and at the same time, to move points E, E of separation of air from the ball rearward to thereby narrow an eddy zone 2 aft of the ball and move it rearward, reducing the pressure difference between the leading and trailing ends of the ball 1. As a consequence, the flying distance of the ball can be increased. By uniformly distributing different types of dimples, a desired dimple effect can be always achieved for any spinning axes.

Figure 5:
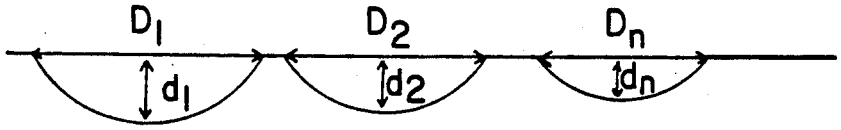
FIG. 5 illustrates the approximate nature of the ratios of the different kinds of dimples of the present invention.

According to the present invention, in a golf ball comprising at least two different types of generally circular dimples, the difference between the diameter divided by the depth of each dimple, that is, the ratio of diameter to depth, for one type of dimples and that for another type of dimples is up to 0.3, preferably up to 0.1. That is, $|Dm1/Dp1-Dm2/Dp2| \leqq 0.3$ wherein dimples of one group has a diameter Dm1 and a depth Dp199 and dimples of another group has a diameter Dm2 and a depth Dp2. Then the dimples of one type are in substantial or complete conformity to those of the other type. FIG. 5 graphically shows the approximate nature of the ratios of the dimples of three or more pluralities of dimple types. Then all the dimples show substantially identical aerodynamic properties to ensure that the individual dimples may exert their own dimple effect, leading to improved flying performance.

The dimples arranged in the spherical surface of a ball include two or more types each preferably having a diameter in the range of from 2.7 to 4.4 mm and a depth in the range of from 0.15 to 0.24 mm, the depth being a depth of a dimple in a radial direction of the ball. Preferably the ball includes two or more types of dimples each type having a ratio of diameter to depth in the range between 10 and 35, more preferably between 13 and 25 though the invention is not limited thereto. Often two, three or four types of dimples are formed on a ball although more types of dimples may be included.

When a ball includes two types of dimples, that is, larger and smaller dimples, the number of larger dimples preferably ranges from 40 to 60%, more preferably from 40 to 50% of the total number of dimples. When a ball includes m types of dimples wherein m is an odd number of at least 3, the number of the largest dimples and the (m+1)/2-th largest dimples preferably ranges from 50 to 90%, more preferably from 65 to 85% of the total number of dimples. When a ball includes n types of dimples wherein n is an even number of at least 4, the number of the largest dimples and the n/2-th largest dimples preferably ranges from 25 to 60%, more preferably from 25 to 50% of the total number of dimples.

The golf balls of the invention may be either solid balls including one and two-piece balls or thread-wound balls. The distribution and total number of dimples are not particularly limited although 300 to 550 dimples, preferably 350 to 540 dimples are generally formed on a ball.

Preferred dimple arrangements are regular icosahedral, regular dodecahedral, and regular octahedral arrangements. The dimples may preferably be distributed uniformly on the ball surface according to any of the above mentioned arrangements.

The dimple design defined by the present invention may be applied to any type of golf ball including small balls having a diameter of at least 41.15 mm and a weight of up to 45.92 g, and large balls having a diameter of at least 42.67 mm and a weight of up to 45.92 g.

EXAMPLE

Examples of the invention are given below by way of illustration and not by way of limitation.

Examples 1-2 and Comparative Examples 1-3

Figure 2:
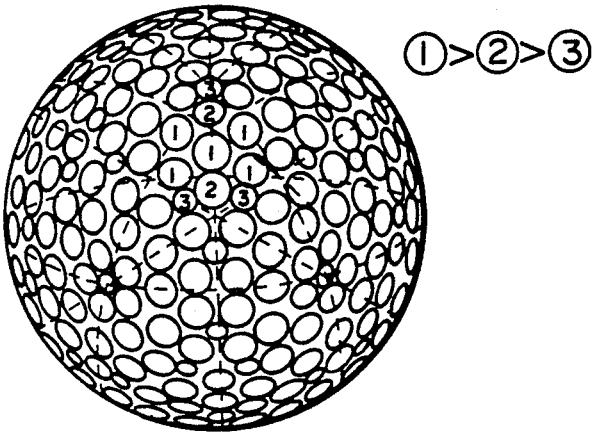
FIGS. 2 to 4 are plan views showing different distribution patterns of dimples on golf balls.
Figure 3:
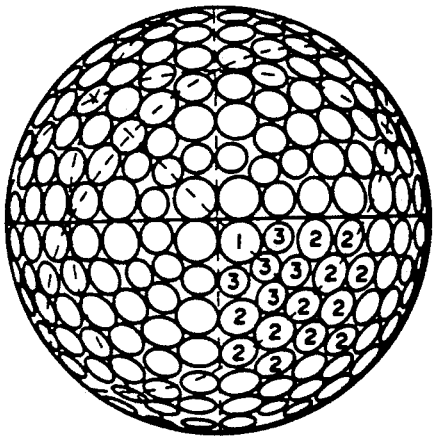

There were prepared two-piece balls and thread-wound balls, both of the large size, each having three types of dimples as shown in Table 1. The dimple distribution patterns used are shown in FIGS. 2 and 3. In the figures, numeral 1 designates the largest dimples, 2 designates second largest dimples, and 3 designates the smallest dimples.

| Two piece ball | |
|---|---|
| Composition | Parts by weight |
| Core | |
| Cis-1,4-polybutadiene rubber | 100 |
| Zinc dimethacrylate | 30 |
| Filler | appropriate |
| Peroxide | appropriate |
| Cover | |
| Ionomer resin (Surlyn ® 1707, E. I. duPont, Shore D hardness 68) | 100 |
| Titanium dioxide | 1 |

-continued

| Two piece ball | |
|---|---|
| Composition | Parts by weight |
| Thickness | 2.3 mm |

A solid core was formed by vulcanizing the core composition in a mold at 150° C. for 25 minutes. The solid core was coated with the cover composition, which was compression molded in a mold at 130° C. for 3 minutes. There was prepared a large-size, two-piece ball having a diameter of 42.7 mm, a weight of 45.2 grams, and a hardness of 100 as measured by the USGA standard.

| Thread-wound ball | |
|---|---|
| Composition | Parts by weight |
| Center | |
| Cis-1,4 polybutadiene rubber | 100 |
| Sulfur | 5 |
| Zinc oxide | 10 |
| Barium sulfate | 68 |
| Vulcanization accelerator | 1 |
| Accelerator aid | 3 |
| Thread rubber | |
| Cis-1,4-polyisoprene rubber | 50 |
| Natural rubber | 50 |
| Sulfur | 1 |
| Zinc oxide | 0.6 |
| Vulcanization accelerator | 1.5 |
| Accelerator aid | 1 |
| Cover | |
| Ionomer resin (Surlyn ® 1557, E. I. duPont, Shore D hardness 63) | 100 |
| Titanium dioxide | 1 |
| Thickness | 2.0 mm |

A center was formed by vulcanizing the center composition at 150° C. for 20 minutes. The thread rubber was vulcanized at 150° C. for 40 minutes. The thread rubber was wound on the center, and the thread wound center was coated with the cover composition, which was compression molded at 150° C. for 5 minutes. There was prepared a large-size, ionomer covered, thread-wound ball having a diameter of 42.7 mm, a weight of 45.2 grams, and a hardness of 90 as measured by the PGA standard.

To evaluate the flying distance of these balls, a hitting test was carried out using a swing robot manufactured by True Temper Co. The ball was hit at a head speed of 45 m/sec. and the flying distance (total distance) covered by the ball was evaluated according to the following criterion.

| Criterion for two-piece balls |
|---|
| O: longer than 225 m |
| Δ: 223-225 mm |
| X: shorter than 223 m |
| **Criterion for thread-wound balls** |
| O: longer than 223 m |
| Δ: 221-225 mm |
| X: shorter than 221 m |

TABLE 1

| | Dimple Designation | Diameter (Dm) | Depth (Dp) | $\frac{Dm}{Dp}$ | Dimple number | Total dimple number | $\left\lvert \frac{Dm1}{Dp1} - \frac{Dm2}{Dp2} \right\rvert$ |
|---|---|---|---|---|---|---|---|
| Example 1 | 1 | 3.50 mm | 0.200 mm | 1750 | 240 | 432 | 0.01 |
| | 2 | 3.20 | 0.183 | 17.49 | 120 | | |

TABLE 1-continued

| | | | | | | | |
|---|---|---|---|---|---|---|---|
| | 3 | 2.90 | 0.165 | 17.58 | 72 | | |
| Example 2 | 1 | 4.00 | 0.187 | 21.39 | 24 | 392 | 0.04 |
| | 2 | 3.90 | 0.182 | 21.43 | 248 | | |
| | 3 | 3.40 | 0.159 | 21.38 | 120 | | |
| Comparative Example 1 | 1 | 3.50 | 0.195 | 17.95 | 240 | 432 | 1.54 |
| | 2 | 3.20 | 0.195 | 16.41 | 120 | | |
| | 3 | 2.90 | 0.195 | 14.87 | 72 | | |
| Comparative Example 2 | 1 | 3.50 | 0.205 | 17.07 | 240 | 432 | 1.75 |
| | 2 | 3.20 | 0.170 | 18.82 | 120 | | |
| | 3 | 2.90 | 0.170 | 17.06 | 72 | | |
| Comparative Example 3 | 1 | 4.00 | 0.175 | 22.86 | 24 | 392 | 0.57 |
| | 2 | 3.90 | 0.175 | 22.29 | 248 | | |
| | 3 | 3.40 | 0.175 | 19.43 | 120 | | |

| | $\left\lvert \frac{Dm1}{Dp1} - \frac{Dm3}{Dp3} \right\rvert$ | $\left\lvert \frac{Dm2}{Dp2} - \frac{Dm3}{Dp3} \right\rvert$ | Dimple distribution pattern | Flying performance |
|---|---|---|---|---|
| Example 1 | 0.08 | 0.09 | FIG. 2 | O |
| Example 2 | 0.01 | 0.05 | FIG. 3 | O |
| Comparative Example 1 | 3.08 | 1.54 | FIG. 2 | X |
| Comparative Example 2 | 0.01 | 1.76 | FIG. 2 | Δ |
| Comparative Example 3 | 3.43 | 2.86 | FIG. 3 | Δ |

Example 3 and Comparative Examples 4–5

Figure 4:
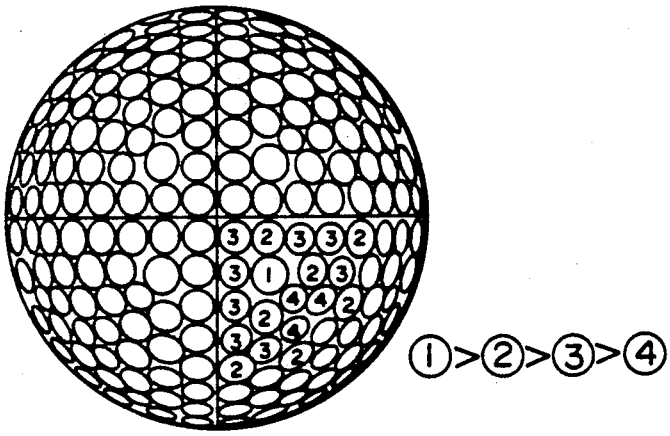

Two-piece balls and thread-wound balls, both of the large size, each having four types of dimples as shown in Table 2 were prepared by the same procedures as in Example 1. The dimple distribution pattern is shown in FIG. 4. In the figure, numeral 1 designates the largest dimples, 2 designates second largest dimples, 3 designates third largest dimples, and 4 designates the smallest dimples.

The flying performance of the balls was evaluated by the same procedure as in Example 1. The results are shown in Table 2.

TABLE 2

| | Dimple Designation | Diameter (Dm) | Depth (Dp) | $\frac{Dm}{Dp}$ | Dimple number | Total dimple number | $\left\lvert \frac{Dm1}{Dp1} - \frac{Dm2}{Dp2} \right\rvert$ | $\left\lvert \frac{Dm1}{Dp1} - \frac{Dm3}{Dp3} \right\rvert$ |
|---|---|---|---|---|---|---|---|---|
| Example 3 | 1 | 4.00 mm | 0.195 mm | 20.51 | 24 | 432 | 0.03 | 0.05 |
| | 2 | 3.80 | 0.185 | 20.54 | 96 | | | |
| | 3 | 3.70 | 0.180 | 20.56 | 216 | | | |
| | 4 | 3.35 | 0.163 | 20.55 | 96 | | | |
| Comparative Example 4 | 1 | 4.00 | 0.185 | 21.62 | 24 | 432 | 1.08 | 1.07 |
| | 2 | 3.80 | 0.185 | 20.54 | 96 | | | |
| | 3 | 3.70 | 0.180 | 20.55 | 216 | | | |
| | 4 | 3.35 | 0.180 | 18.61 | 96 | | | |
| Comparative Example 5 | 1 | 4.00 | 0.180 | 22.22 | 24 | 432 | 1.11 | 1.66 |
| | 2 | 3.80 | 0.180 | 21.11 | 96 | | | |
| | 3 | 3.70 | 0.180 | 20.56 | 216 | | | |
| | 4 | 3.35 | 0.180 | 18.61 | 96 | | | |

| | $\left\lvert \frac{Dm1}{Dp1} - \frac{Dm4}{Dp4} \right\rvert$ | $\left\lvert \frac{Dm2}{Dp2} - \frac{Dm3}{Dp3} \right\rvert$ | $\left\lvert \frac{Dm2}{Dp2} - \frac{Dm4}{Dp4} \right\rvert$ | $\left\lvert \frac{Dm3}{Dp3} - \frac{Dm4}{Dp4} \right\rvert$ | Dimple distribution pattern | Flying performance |
|---|---|---|---|---|---|---|
| Example 3 | 0.04 | 0.02 | 0.01 | 0.01 | FIG. 4 | O |
| Comparative Example 4 | 3.01 | 0.01 | 1.93 | 1.94 | FIG. 4 | Δ |
| Comparative Example 5 | 3.61 | 0.55 | 2.50 | 1.95 | FIG. 4 | X |

There has been described a gold ball comprising at least two different types of dimples wherein the difference between the ratio of diameter to depth of each dimple for one type of dimples and that ratio for another type of dimples is up to 0.3. The dimples exert their function to a full extent, increasing the flying distance of the ball.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A golf ball comprising at least three pluralities of dimples of different diameters each of said pluralities of dimples having a single type of dimple, said single type of dimple having a diameter, a depth, and a ratio of said diameter to said depth, said single type of dimple of one plurality of dimples differing in diameter from said single type of dimples of every other plurality of dimples, wherein the difference between the ratio corresponding to any one of said pluralities of dimples and the ratio corresponding to any other of said pluralities of dimples is no greater than 0.3.

2. A golf ball of claim 1 wherein the difference between the ratio corresponding to any one of said pluralities of dimples and the ratio corresponding to any other of said pluralities of dimples is no greater than 0.1.

3. The golf ball of claim 1, wherein, for any said single type of dimple of said pluralities of dimples, said diameter ranges from 2.7 to 4.4 mm, said depth ranges from 0.15 to 0.24 mm, and said ratio ranges between 10 to 35.

4. The golf ball of claim 1 wherein the number of pluralities of dimples present is an odd number m of at least 3 and the total of the number of dimples having the largest diameter and the number of dimples having the x largest diameter ranges from 50 to 90% of the total number of dimples of all said pluralities of dimples, with x being the ordinal number, corresponding to cardinal number determined by the equation, $(m+1)/2$.

5. The golf ball of claim 1 wherein the number of said pluralities of dimples present is an even number n of at least 4 and the total of the number of dimples having the largest diameter and the number of dimples having the x largest diameter ranges from 25 to 60% of the total number of dimples of all said pluralities of dimples, with x being the ordinal number, corresponding to the cardinal number determined by the equation, $n/2$.

* * * * *